US007089604B2

(12) United States Patent
Wright et al.

(10) Patent No.: US 7,089,604 B2
(45) Date of Patent: Aug. 15, 2006

(54) TOILET SUPPORT DEVICE AND METHOD

(76) Inventors: Glenn H. Wright, 175 Bunch Mountain Rd., Adairsville, GA (US) 30103; Timothy Popadics, 223 Wade Dr., Calhoun, GA (US) 30701

( * ) Notice: Subject to any disclaimer, the term of this patent is extended or adjusted under 35 U.S.C. 154(b) by 0 days.

(21) Appl. No.: 10/701,812

(22) Filed: Nov. 5, 2003

(65) Prior Publication Data

US 2005/0091733 A1 May 5, 2005

(51) Int. Cl.
*E03D 11/00* (2006.01)

(52) U.S. Cl. ..... 4/252.1

(58) Field of Classification Search ..... 4/252.1–252.3, 4/300, 643–646; 248/188.4, 188.6
See application file for complete search history.

(56) References Cited

U.S. PATENT DOCUMENTS 957,306 A * 5/1910 Christensen ..... 4/420
2,535,613 A * 12/1950 Vanderbeek ..... 248/188.4
3,924,279 A 12/1975 Morris et al.
4,058,859 A 11/1977 Arrowood
4,168,552 A 9/1979 Austin
4,343,052 A 8/1982 Guenther
4,715,069 A 12/1987 James
4,979,239 A 12/1990 Klein et al.
5,150,480 A 9/1992 Schmucki
5,373,593 A * 12/1994 Decky et al. ..... 4/661
5,933,877 A 8/1999 Wu
6,199,228 B1 3/2001 Kallweit
6,553,582 B1 4/2003 Clark

* cited by examiner

*Primary Examiner*—Charles E. Phillips
(74) *Attorney, Agent, or Firm*—Williamson Intellectual Property Law, LLC; Thomas R. Williamson, III

(57) ABSTRACT

A device and method for providing support to a toilet bowl suitable to sustain the weight of an obese or otherwise large individual. The device comprises a support bar placed underneath the toilet and affixed to the toilet wall support, and a leg between the toilet bowl and the floor. The leg is hinged to allow folding thereof to facilitate cleaning under the toilet bowl.

5 Claims, 4 Drawing Sheets

TOILET SUPPORT DEVICE AND METHOD

TECHNICAL FIELD

The present invention relates generally to an apparatus and method for providing support to a toilet bowl. The toilet support device and method of the present invention is particularly suited for, although not limited to, use on a toilet bowl having a high mass load.

BACKGROUND OF THE INVENTION

The present invention began out of a need for a device to support toilets for bariatric patients; that is, patients of weight in excess of the weights of typical patients. A person having a body mass index of forty or greater (often more than one hundred pounds over their ideal body weight) may be considered morbidly obese and a suitable candidate for bariatric surgery. Such a person would be considered a bariatric patient. Standard toilets are designed to sustain high loadings, but under extreme weight may be subject to fracture.

There are various devices and methods available for providing support to toilet appliances or to the person utilizing them, but all are disadvantageous when compared to the present invention. Some devices are designed to provide strengthening of the attachment point of the toilet to the wall in order to assist in providing a toilet device that can withstand high weights; however, because such devices provide no support to the bowl itself, and due to the lever moment of the toilet bowl about the attachment point, excess weight applied to the bowl area can easily lead to failure of the wall mount. Other devices provide supports above the toilet bowl to facilitate grasping by the user, to assist the user in supporting himself without bringing full weight on to the toilet bowl. Clearly, such devices do not provide support to the toilet bowl, and in the event of failure, bring full weight of the user on to the toilet bowl, as these devices are mostly utilized to assist the user in positioning himself upon the bowl.

While some or all of the above-referenced patents may be utilized for supporting a patient above a toilet bowl, or for supporting a patient of average weight upon a toilet bowl, each fails to adequately provide reliable support to a heavily loaded toilet bowl.

Therefore, it is readily apparent that there is a need for a novel device and method for supporting a toilet bowl, wherein the maximum weight load capability of a toilet is increased, thus enabling secure support of obese individuals thereon and avoiding the above-discussed disadvantages.

BRIEF SUMMARY OF THE INVENTION

Briefly described, in a preferred embodiment, the present invention overcomes the above-mentioned disadvantages and meets the recognized need for such a device by providing a method and apparatus for supporting a toilet bowl under stress of heavy loads.

According to its major aspects and broadly stated, the present invention in its preferred embodiment is a support plate and leg unit for utilization between the base of a toilet bowl and the floor therebelow, thereby buttressing the toilet bowl.

A feature and advantage of the present invention is its ability to provide support to a toilet bowl.

A further feature and advantage of the present invention is its ability to assist a toilet appliance in supporting heavy weight loads.

A feature and advantage of the present invention is that it can be retracted for cleaning of the floor under the toilet bowl.

A further feature and advantage of the present invention is its ease of manufacture and low cost of production.

These and other features and advantages of the present invention will become more apparent to one skilled in the art from the following description and claims when read in light of the accompanying drawings.

BRIEF DESCRIPTION OF THE DRAWINGS

Figure 1:
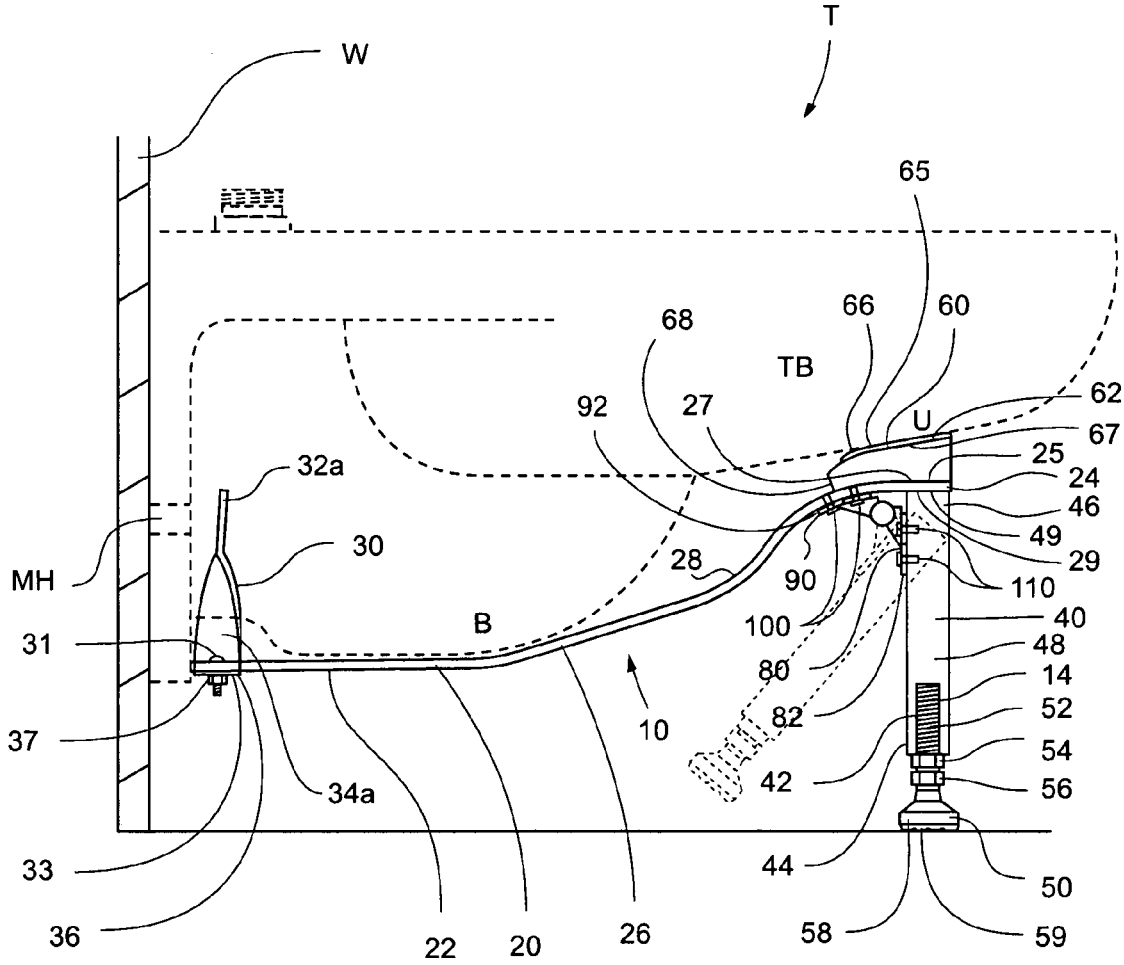
Figure 2:
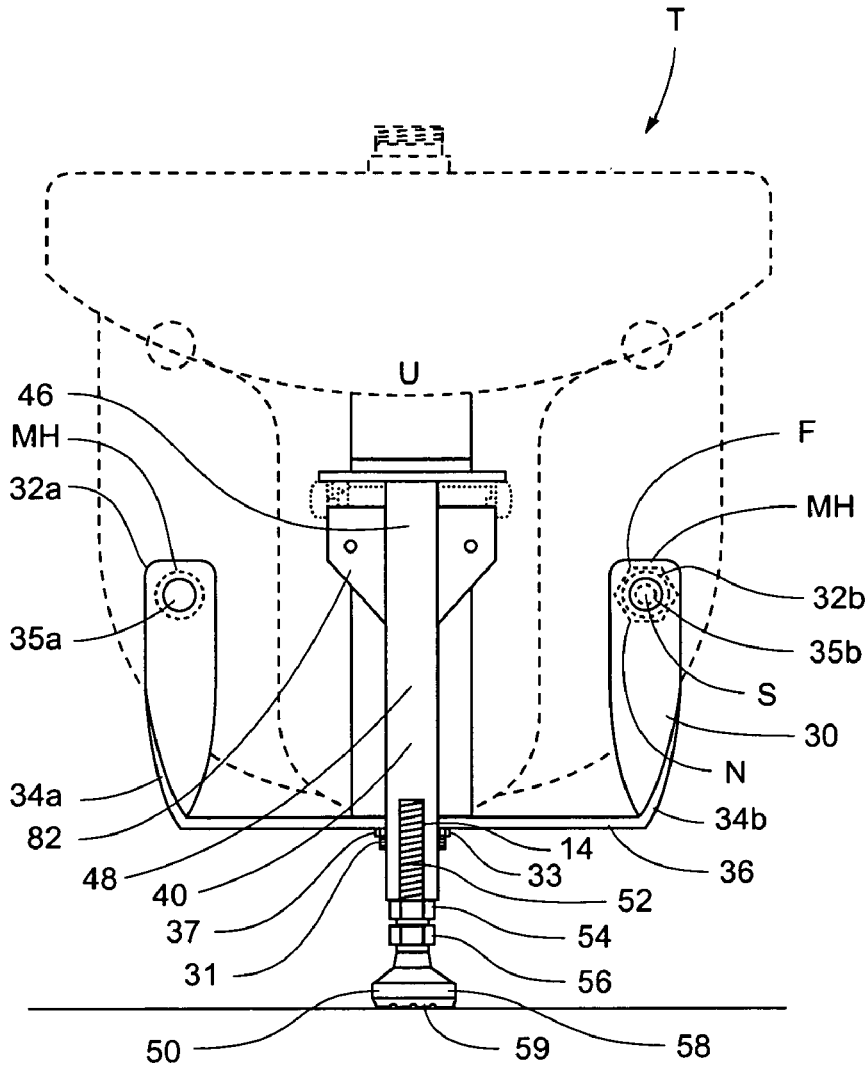
Figure 3A:
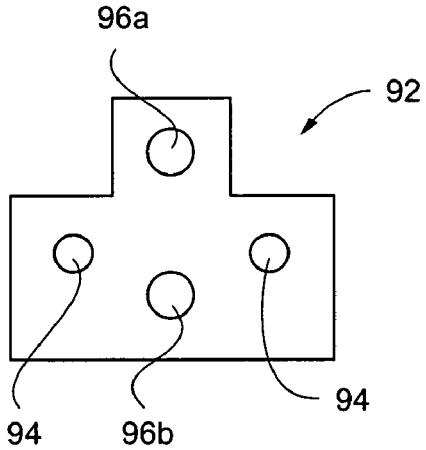
Figure 3B:
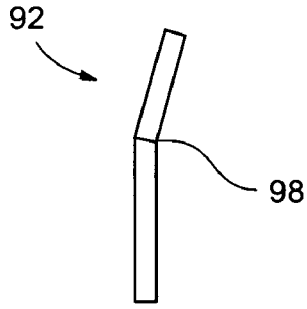
Figure 4A:
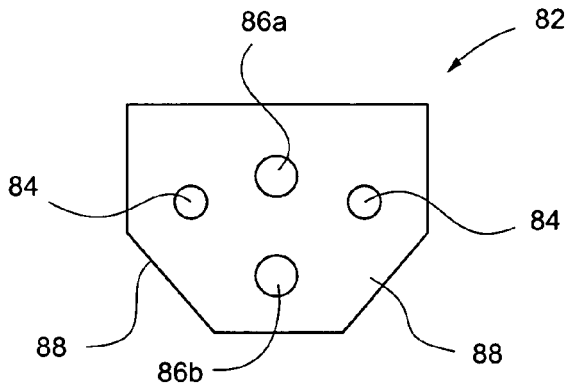
Figure 4B:
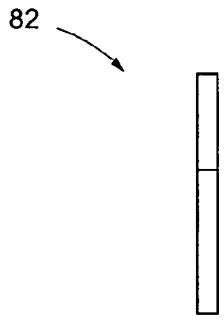
Figure 5A:
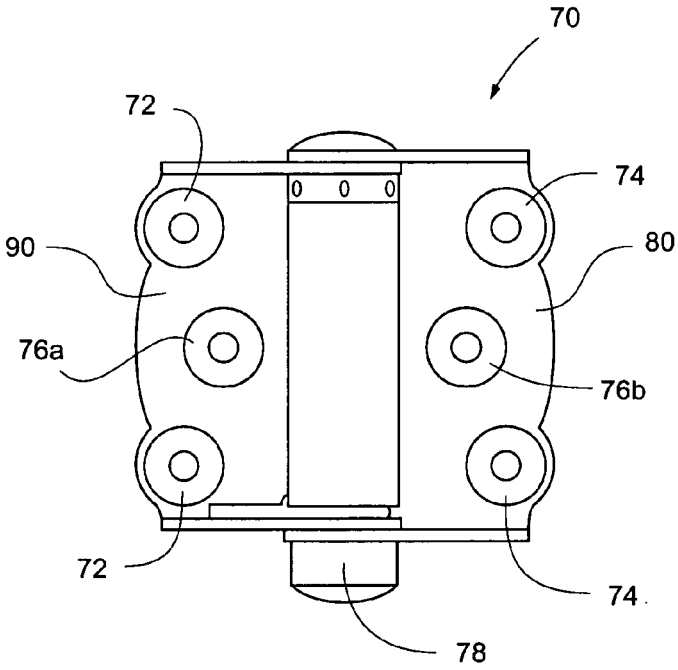
Figure 5B:
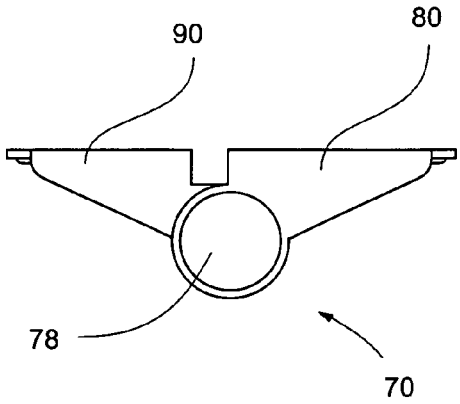
Figure 6:
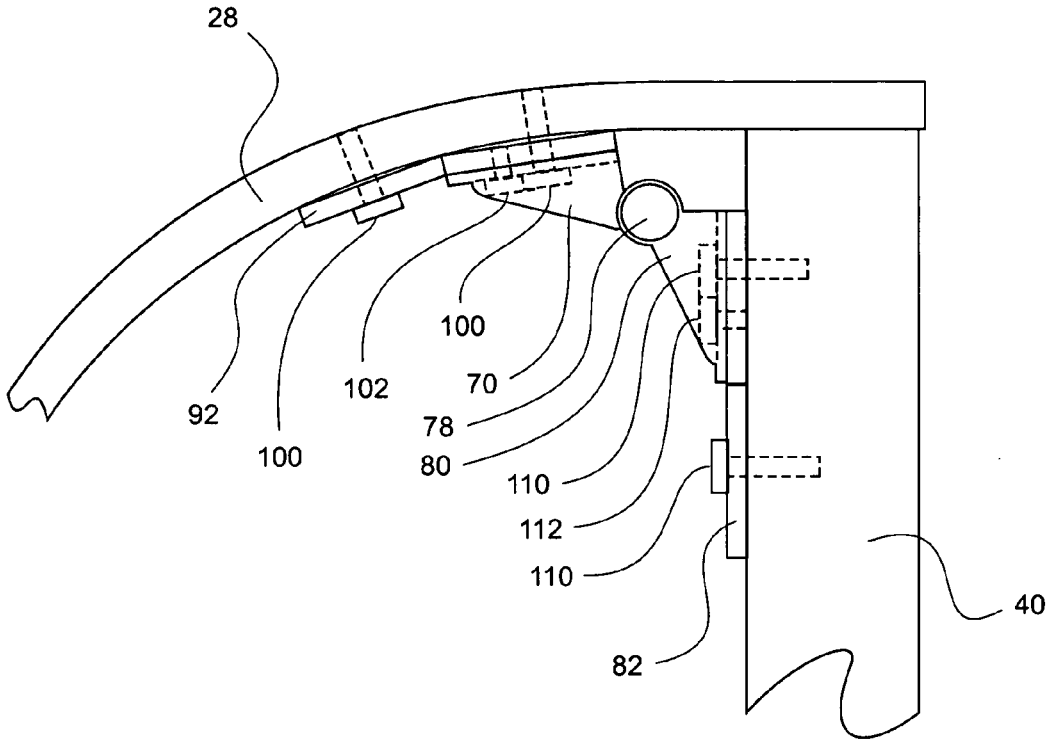

Having thus described the invention in general terms, the present invention will be better understood by reading the Detailed Description of the Preferred and Selected Alternate Embodiments with reference to the accompanying drawing figures, which are not necessarily drawn to scale, and in which like reference numerals denote similar structures and refer to like elements throughout, and in which:

FIG. 1 depicts a side sectional view of the preferred embodiment of the present invention;

FIG. 2 depicts a front view of the preferred embodiment of the present invention;

FIG. 3A is a top plan view of a mounting plate component of the preferred embodiment of the present invention;

FIG. 3B is a side view of a mounting plate component of the preferred embodiment of the present invention;

FIG. 4A is a top plan view of a mounting plate component of the preferred embodiment of the present invention;

FIG. 4B is a side view of a mounting plate component of the preferred embodiment of the present invention;

FIG. 5A is a top plan view of a hinge component according to a preferred embodiment of the present invention;

FIG. 5B is a side view of a hinge component according to a preferred embodiment of the present invention; and FIG. 6 is a detail view of attachment of a hinge component according to a preferred embodiment of the present invention.

DETAILED DESCRIPTION OF THE PREFERRED AND SELECTED ALTERNATE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1 through 5B, apparatus 10 is preferably an support bar 20 preferably made from a suitably strong, rigid and formable material, such as, for exemplary purposes only, steel and preferably having a generally elongated 'S'-shape. While steel is preferable for utilization in the present invention, it will be evident to those skilled in the art that other appropriately strong materials may be utilized and still fall within the confines of the present invention, such as, for exemplary purposes only, wood, coated metal, cut stone, or reinforced man-made materials. Also, although a generally elongated 'S'-shape is preferred for support bar 20, other shapes could be utilized to conform and/or generally mate with exterior contours of any toilet bowl shape.

Support bar 20 preferably has first end 22, second end 24 and body 26. Preferably located proximate first end 22 of 'S'-bar 20 is hanger 30. Referring now to FIG. 2, hanger 30 preferably has a generally 'U'-shaped configuration defined by top ends 32*a* and 32*b*, side flanges 34*a* and 34*b*, and base 36. Hanger 30 is preferably an integral unit, wherein side flanges 34*a* and 34*b* preferably extend upward relative to base 36, with top ends 32*a* and 32*b*, respectively, preferably defined at an angle relative thereto, in order to enable substantially flush placement when attached to toilet bowl TB. Referring again to FIG. 1, base 36 of hanger 30 is preferably fixably attached to first end 22 of support bar 20, preferably via bolts 31, wherein bolts 31 preferably extend through co-located holes 37 in hanger 30 and support bar 20 and are preferably secured via nuts 33. Hanger 30 further preferably has holes 35*a* and 35*b*, preferably defined proximate top ends 32*a* and 32*b*, as seen in FIG. 2.

Body 26 of support bar 20 is preferably suitably formed to follow the contour of the base B of toilet T, including toilet bowl TB, wherein the preferable 'S'-shaped section 28, follows the contour of a commonly-shaped base B. Bumper 60 is preferably affixed proximate top 25 of second end 24 of support bar 20. Bumper 60 is preferably made of a firm, yet resilient material, such as, for exemplary purposes only, rubber. While rubber is preferred, it will be evident to those in the art that other resilient or cushioning-type materials may be utilized within the present invention for construction of bumper 60.

Film 66 preferably substantially covers surface 62 of bumper 60. Film 66 is preferably thin, with first surface 67 that adheres to bumper 60, and second surface 65 that is preferably not adherent, particularly non-adherent to porcelain, but which has a generally frictional surface 62. A preferable material for forming film 66 is, for exemplary purposes only, INSUL-GRIP®, as manufactured by INSUL-TAB, Inc. of Woburn, Mass.

Bumper 60 is preferably positioned to enable bottom footprint 27 of bumper 60 to contact top 25 of second end 24 of support bar 20. In operation, leg 40 is preferably raised to position bumper 60 such that film 66 is preferably in contact against underneath U of toilet bowl TB. Bumper 60 is preferably generally wedge-shaped to most suitably conform to underneath U of typical toilet bowl TB, although it is anticipated herein that other toilet apparatuses may require bumper 60 to be in a different shape, and any such shape could be utilized without departing from the intended scope of the present invention.

Leg 40 preferably supports first end 24 of support bar 20, wherein top end 46 of leg 40 is preferably located below support bar 20, preferably proximate bottom 29 of first end 24 thereof, and wherein surface footprint 49 at first end 46 of leg 40 is preferably in contact with bottom 29 of first end 24 of support bar 20. In addition to top end 46, leg 40 is preferably defined by body 48 and base end 44. Leg 40 is preferably solid stainless steel, and has threaded receptacle 42 drilled and tapped therein at second end 44. It will be recognized by those in the art that leg 40 may be made from other strong materials, and that other means of length adjustment could be utilized, without departing from the present invention.

Foot 50 is preferably attached to base end 44 of leg 40. Foot 50 is preferably a swivel leveling mount, such as, for exemplary purposes only, as is available from McMaster-Carr of Atlanta, Georgia, having threaded rod 52, nut 54, jam nut 56, base 58 and non-skid pad 59. Threaded receptacle 42 of leg 40 is preferably dimensioned to receive threaded rod 52 of foot 50 therein, thereby securing foot 50 to leg 40 and permitting screw adjustment of height of foot 50. Nut 54 and jam nut 56 are preferably positioned on threaded rod 52, wherein nut 54 is preferably adjusted on threaded rod 52 such that when threaded rod 52 is inserted and screwed into threaded receptacle 42 of leg 40, nut 54 will preferably function as a stop to prevent further insertion of threaded rod 52, thereby preferably setting the height of foot 50. Thus, upon adjusting the height of foot 50, leg 40, support bar 20, bumper 60 and film 66, according to the preferred configuration, a compressive force is delivered against underneath U of toilet bowl TB, thereby preventing downward deflection of toilet bowl TB when toilet bowl TB is under load. Jam nut 56 is preferably used to jam against nut 54 in order to prevent threaded rod 52 from rotating, thereby preferably securing nut 54 and preferably firmly fixing the height of foot 50.

Preferably attached to support bar 20 is top hinge plate 92 (best shown in FIGS. 3A and 3B), wherein top hinge plate 92 is preferably a 'T'-shaped rigid mounting plate, preferably comprised of sheet stainless steel. It will be recognized by those in the art that other materials and other shapes could be utilized to form top hinge plate 92, such as for exemplary purposes only, iron, steel, plastic, rubber, wood and or similar materials, with or without protective coatings thereon. Preferably, hinge mounting holes 94 and support bar mounting holes 96*a* and 96*b* are defined in top hinge plate 92, wherein top hinge plate 92 is preferably secured to support bar 20 via fasteners 100, preferably though support bar mounting holes 96*a* and 96*b*. Hinge 70 is preferably secured to top hinge plate 92 through holes 72 via fasteners 102, wherein fasteners 102 preferably attach top hinge flange 90 to top hinge plate 92 via hinge mounting holes 94 in top hinge plate 92. Support bar mounting hole 96*b* could be utilized in an alternative embodiment to permit utilization of a single fastener to secure top hinge plate 92 and support bar 20 together via a common fastener.

Preferably, top hinge plate 92 has angle or bend 98 defined therein to facilitate attachment to 'S'-shaped section 28 of support bar 20.

Referring now to FIG. 6, top hinge plate 92 preferably serves to provide a wider mounting area for attachment of hinge 70, wherein top hinge flange 90 is preferably attached to top hinge plate 92 via suitable fasteners 100, thus allowing the use of a large hinge of suitable strength. It will be recognized by those skilled in the art that a smaller hinge of suitable strength could be mounted to support bar 20 directly without resort to using top hinge plate 92.

Preferably side hinge plate 82 (best shown in FIGS. 4A and 4B) is attached to leg 40, wherein side hinge plate 82 is preferably an irregular shaped mounting plate, preferably formed from sheet stainless steel. It will be recognized by those in the art that other materials and/or shapes could be utilized to form side hinge plate 82, such as for exemplary purposes only, iron, steel, plastic, rubber, wood and/or similar materials, with or without protective coatings thereon. Hinge mounting holes 84 and leg mounting holes 86*a* and 86*b* are preferably defined in side hinge plate 82, wherein side hinge plate 82 is preferably secured to leg 40 via fasteners 110, preferably though leg mounting holes 86*a* and 86*b* of side hinge plate 82. Hinge 70 is preferably secured to side hinge plate 82 through holes 74 via fasteners 112, wherein fasteners 112 preferably attach side hinge flange 80 to side hinge plate 82 via hinge mounting holes 84. Leg mounting hole 86*b* could be utilized in an alternative embodiment to permit utilization of a single fastener to secure side hinge flange 80, side hinge plate 82 and leg 40 together via a common fastener.

Referring now to FIG. 6, side hinge plate 82 serves to provide a wider mounting area for attachment of hinge 70, wherein side hinge flange 80 is attached to side hinge plate 82 via suitable fasteners 112, thus allowing the use of a large hinge of suitable strength. It will be recognized by those skilled in the art that a smaller hinge of suitable strength could be mounted to leg 40 directly without resort to using side hinge plate 82.

Thus, leg 40 is preferably hingably attached to support bar 20 via top hinge plate 92, side hinge plate 82 and hinge 70, wherein hinge 70 (as best shown in FIGS. 5A and 5B) preferably comprises bottom hinge flange 80 and top hinge flange 90. Bottom hinge flange 80 is preferably fixably attached to side hinge plate 82 and leg 40 via suitable fastening means 110, such as for exemplary purposes only, machine screws and nuts, although it will be recognized by those in the art that other fastening means may also be utilized.

Top hinge flange 90 is preferably located proximate narrow end 68 of bumper 60 and is preferably fixably attached to top hinge plate 92 via fasteners 102 and wherein top hinge plate 92 is attach to support bar 20 via suitable fastening means 100, such as, for exemplary purposes only, machine screws and nuts, although it will be recognized by those in the art that other suitable fastening means may be utilized.

Hinge 70 preferably comprises hinge body 78, with top hinge flange 90 and bottom hinge flange 80 hingably attached thereto. Preferably, hinge mounting holes 72 are defined in top hinge flange 90. Preferably, hinge mounting holes 74 are defined in bottom hinge flange 80. Also preferably, mounting hole 76*a* is defined in top hinge flange 90 to enable an alternate embodiment, wherein mounting hole 76*a* facilitates attachment of hinge 70 to top hinge plate 92 and support bar 20 via a common fastener. Likewise, mounting hole 76*b*, is preferably defined in bottom hinge flange 80 to enable an alternate embodiment, wherein mounting hole 76*b* facilitates attachment of hinge 70 to side hinge plate 82 and support bar 20 via a common fastener.

Returning to FIGS. 1 and 2, in use, toilet T is preferably secured to wall W via known fastening means F, wherein fastening means F comprises, for exemplary purposes only, stud S with nut N, wherein studs S extend through mounting holes MH in toilet T. Upon removal of nuts N, studs S preferably protrudes from toilet T. While keeping toilet T in place, holes 35*a* and 35*b* of hanger 30 are preferably placed over studs S, and previously-removed nuts N are replaced, thereby preferably securing apparatus 10 to wall mount WM. Once apparatus 10 is secured to wall W, bumper 60 is preferably positioned below and proximate underneath U of toilet bowl TB. Leg 40 is then preferably extended downward from support bar 20 into position opening hinge 70 and positioning leg 40 substantially vertical, wherein surface footprint 49 of top end 46 of leg 40 preferably contacts bottom 27 of first end 24 of support bar 20. Foot 50 is preferably adjusted by screwing threaded rod 52 into or out of threaded receptacle 42 to preferably provide selected compression pressure by bumper 60 against underneath U of toilet bowl TB, whereupon nuts 54 and 56 are preferably secured to fix the selected height of leg 40, and compression delivered thereby. When desirable to have clear passage under apparatus 10, such as for cleaning of floor under toilet bowl TB, leg 40 is preferably returned to its original, hingedly-folded position by reversing the steps above.

It is envisioned in an alternate embodiment that leg 40 could be any shape, such as, for exemplary purposes only, cylindrical or rectangular/prismatic.

It is envisioned in an alternate embodiment that leg 40 could be hollow and could support a threaded insert suitable for inserting and securing foot 50.

It is envisioned in an alternate embodiment that leg 40 could be a single resilient member forced into position below toilet bowl TB.

It is also invisioned in an alterate embodiment that leg 40 could be permanently installed.

It is further envisioned in an alternate embodiment that leg 40 could be integrally formed into porcelain shell of toilet bowl TB, whereby it could be rendered virtually invisible.

It is envisioned in a further alternate embodiment that leg 40 could be hydraulicly operated.

It is contemplated in an alternative embodiment that 'S'-bar 20 could define any shape suitable to facilitate installation beneath the bowl of toilet T.

It is contemplated in another alternate embodiment that support bar 20 could be formed of a leg portion only.

It is contemplated in yet another alternate embodiment that hinges and plates could be any shape, size, or configuration capable of performing essentially the same function.

It is contemplated in still another alternate embodiment that apparatus 10 could attach to toilet or wall via any necessary configuration depending upon toilet type and/or design.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing the steps of the method in a certain order does not constitute any limitation on the order of the steps of the method. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A system for supporting a toilet bowl comprising:

at least one support bar, wherein said at least one support bar is carried by existing toilet mounts;

at least one leg having means for height adjustment, wherein said at least one leg is hingably fastened to said at least one support bar;

at least one resilient bumper carried by said at least one support bar, wherein said at least one resilient bumper is in contact with the toilet bowl; and at least one foot.

2. The system of claim 1, wherein said means for height adjustment of said at least one leg comprises screw adjustment.

3. The system of claim 1, further comprising a thin film of non-porcelain-adhering material placed over said resilient bumper.

4. The system for supporting a toilet bowl of claim 1, wherein said system is carried substantially beneath the toilet bowl.

5. The system for supporting a toilet bowl of claim 1, wherein said leg is in contact with a floor surface beneath the toilet bowl.

* * * * *

UNITED STATES PATENT AND TRADEMARK OFFICE

CERTIFICATE OF CORRECTION

PATENT NO. : 7,089,604 B2
APPLICATION NO. : 10/701812
DATED : August 15, 2006
INVENTOR(S) : Glenn H. Wright It is certified that error appears in the above-identified patent and that said Letters Patent is hereby corrected as shown below:

On the Title page item (76), delete "Popadics; Timothy".

Signed and Sealed this

Second Day of January, 2007

JON W. DUDAS
*Director of the United States Patent and Trademark Office*